US008254613B2

(12) United States Patent
Yamagishi et al.

(10) Patent No.: US 8,254,613 B2
(45) Date of Patent: Aug. 28, 2012

(54) SPEAKER APPARATUS

(75) Inventors: Makoto Yamagishi, Tokyo (JP); Hideki Seki, Saitama (JP); Yousuke Takahashi, Saitama (JP)

(73) Assignee: Sony Corporation, Tokyo (JP)

( * ) Notice: Subject to any disclaimer, the term of this patent is extended or adjusted under 35 U.S.C. 154(b) by 1501 days.

(21) Appl. No.: 11/705,139

(22) Filed: Feb. 12, 2007

(65) Prior Publication Data

US 2007/0189566 A1 Aug. 16, 2007

(30) Foreign Application Priority Data

Feb. 16, 2006 (JP) ..... 2006-039988

(51) Int. Cl.
*H04R 1/20* (2006.01)

(52) U.S. Cl. ..... 381/338; 381/337

(58) Field of Classification Search ..... None
See application file for complete search history.

(56) References Cited

U.S. PATENT DOCUMENTS

| | | | | | |
|---|---|---|---|---|---|
| 3,851,123 | A | * | 11/1974 | Lipinski et al. | 455/351 |
| 5,535,284 | A | * | 7/1996 | Thornhill et al. | 381/338 |
| 5,687,246 | A | * | 11/1997 | Lancon | 381/386 |
| 5,734,728 | A | * | 3/1998 | Meissner | 381/89 |
| 6,021,208 | A | * | 2/2000 | Kin-Lung | 381/338 |
| 2005/0123162 | A1 | * | 6/2005 | Huffman | 381/337 |

FOREIGN PATENT DOCUMENTS

| | | |
|---|---|---|
| JP | 2-57095 | 2/1990 |
| JP | 04-099000 | 3/1992 |
| JP | 06-098384 | 4/1994 |
| JP | 08-047080 | 2/1996 |
| JP | 2005-033513 | 2/2005 |
| JP | 2005-311986 | 11/2005 |
| JP | 2006-013772 | 1/2006 |

* cited by examiner

*Primary Examiner* — Yuwen Pan
*Assistant Examiner* — Taunya McCarty
(74) *Attorney, Agent, or Firm* — Finnegan, Henderson, Farabow, Garrett & Dunner, L.L.P.

(57) ABSTRACT

A speaker apparatus includes a speaker, a tubular duct extended in order to make the sound generated in the inside of the cabinet of the speaker get to the vicinity of the listener's ears and a support mechanism that rotatably supports the tubular duct in order to bring the front end aperture of the tubular duct to the vicinity of the ears of the listener.

8 Claims, 15 Drawing Sheets

CONTAINED DUCT

EXTENDED DUCT

SPEAKER APPARATUS

CROSS REFERENCES TO RELATED APPLICATIONS

The present invention contains subject matter related to Japanese Patent Application JP 2006-039988 filed in Japanese Patent Office on Feb. 16, 2006, the entire contents of which being incorporated herein by reference.

BACKGROUND OF THE INVENTION

1. Field of the Invention

The present invention relates to a speaker apparatus and, more particularly, relates to a speaker apparatus that can suitably be used as stand alone type speaker apparatus to be installed in a room.

2. Description of the Related Art

Known stand alone type speaker apparatus include those having a bass reflex duct projecting to the front surface side of the baffle plate for the purpose of sufficiently outputting heavy low tones (see, refer to, Jpn. Pat. Appln. Laid-Open Publication No. 2-57095).

SUMMARY OF THE INVENTION

Speaker apparatus having such a configuration are accompanied by a problem that the bass reflex duct that projects to the front surface side of the baffle plate constitutes an obstacle to the listener when he or she is not listening to the sound emitted from the speaker apparatus.

In view of the above-identified problem, it is therefore desirable to provide a speaker apparatus that is not an obstacle to the listener when not listening to the sound emitted from it and sufficiently outputs heavy low tones to the satisfaction of the listener when listening to the sound emitted from it.

According to an aspect of the present invention, there is provided a speaker apparatus including: a speaker; a tubular duct extended in order to make the sound generated in the inside of the cabinet of the speaker get to the vicinity of the listener's ears; and a support mechanism that rotatably supports the tubular duct in order to bring the front end aperture of the tubular duct to the vicinity of the ears of the listener.

Thus, with a speaker apparatus according to the aspect of the invention as defined above, the sound generated in the inside of the cabinet of the speaker is brought to the vicinity of the ears of the listener by way of the front end aperture of the tubular duct so that the listener can listen to sufficiently heavy low tones as the tubular duct is supported at a rotated position when the speaker apparatus is in use, whereas the tubular duct is moved away from the vicinity of the listener's ears to prevent it from constituting an obstacle to the listener as the tubular duct is turned back to and supported at the unrotated position when the speaker apparatus is not in use.

In another aspect of the present invention, there is provided a speaker apparatus including: speakers arranged at the opposite lateral sides of the cabinet of the main body section of the apparatus; a tubular duct extended in order to make the sound generated in the inside of the cabinet of the speaker get to the vicinity of the listener's ears; and a support mechanism that rotatably supports the tubular duct in order to bring the front end aperture of the tubular duct to the vicinity of the ears of the listener when the apparatus is in use and contain the tubular duct in the cabinet of the main body section of the apparatus when the apparatus is not in use.

Thus, with a speaker apparatus according to the another aspect of the invention as defined above, the sound generated in the inside of the cabinet of the speaker is brought to the vicinity of the ears of the listener by way of the front end aperture of the tubular duct so that the listener can listen to sufficiently heavy low tones as the tubular duct is supported at a rotated position when the speaker apparatus is in use, whereas the tubular duct is moved away from the vicinity of the listener's ears to prevent it from constituting an obstacle to the listener as the tubular duct is turned back and supported at the unrotated position and contained in the cabinet of the main body section when the speaker apparatus is not in use.

Thus, according to the present invention, it is possible to realize a speaker apparatus wherein the tubular duct thereof is supported in a rotated state when the speaker apparatus is in use so that the sound generated in the inside of the cabinet of the speaker is brought to the vicinity of the listener's ears by way of the front end aperture of the tubular duct and hence the listener can listen to sufficiently heavy low tones but the tubular duct is brought back to the unrotated state and supported in that state when the speaker apparatus is not in use so that the tubular duct is moved away from the vicinity of the listener's ears to prevent it from constituting an obstacle to the listener. Thus, the speaker apparatus does not constitute any obstacle to the listener when is not listening to the sound but the listener can feel that sufficiently heavy low tones are being output when listening to the sound.

Similarly, according to the present invention, it is possible to realize a speaker apparatus wherein the tubular duct thereof is supported in a rotated state when the speaker apparatus is in use so that the sound generated in the inside of the cabinet of the speaker is brought to the vicinity of the listener's ears by way of the front end aperture of the tubular duct and hence the listener can listen to sufficiently heavy low tones but the tubular duct is brought back to the unrotated state, supported in that state and contained in the cabinet of the main body section when the speaker apparatus is not in use so that the tubular duct is moved away from the vicinity of the listener's ears to prevent it from constituting an obstacle to the listener. Thus, the speaker apparatus does not constitute any obstacle to the listener when is not listening to the sound but the listener can feel that sufficiently heavy low tones are being output when listening to the sound.

The nature, principle and utility of the invention will become more apparent from the following detailed description when read in conjunction with the accompanying drawings in which like parts are designate by like reference numerals or characters.

DETAILED DESCRIPTION OF THE PREFERRED EMBODIMENTS

Now, embodiments of the present invention will be described in greater detail by referring to the accompanying drawings.

(1) First Embodiment

Figure 1:
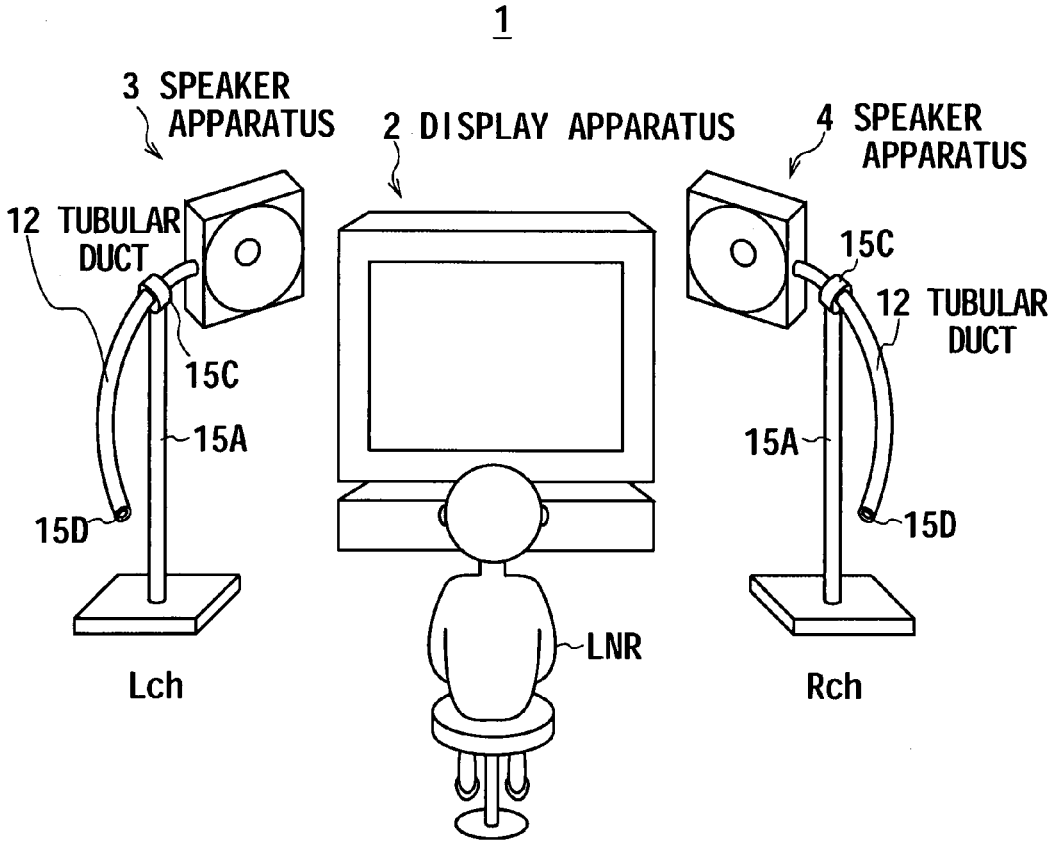
FIG. 1 is a schematic illustration of a speaker system including the speaker apparatus according to the first embodiment of the present invention.

Referring to FIG. 1, reference symbol 1 generally denotes a speaker system formed by using two speaker apparatus according to the first embodiment of the present invention. It includes a display apparatus 2, a speaker apparatus 3 for the left channel and a speaker apparatus 4 for the right channel, the speaker apparatus 3 and 4 being arranged at the opposite lateral sides of the display apparatus 2. The electric signals supplied from the display apparatus 2 respectively to the speaker apparatus 3 for the left channel and the speaker apparatus 4 for the right channel are converted into a sound so that the listener LNR who is right in front of the display apparatus 2 can listen to the sound emitted from the speaker apparatus 3 and 4.

The speaker apparatus 3 for the left channel and the speaker apparatus 4 for the right channel basically have a same structure that is adapted to output sufficiently heavy low tones and provide high quality acoustic effects to the listener if compared with ordinary speaker apparatus.

Now, the specific configuration of the speaker apparatus 3 for the left channel and that of the speaker apparatus 4 for the right channel will be described. However, since the two speaker apparatus have the same structure, only the speaker apparatus 3 for the left channel will be described in detail below. In other words, the description of the speaker apparatus 4 for the right channel is omitted.

Figure 2A:
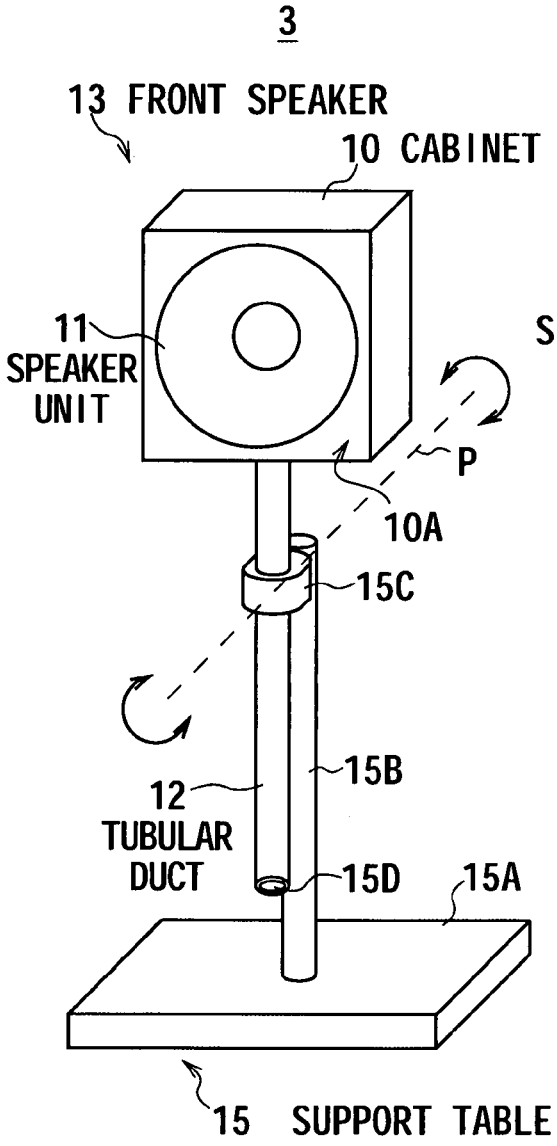
FIGS. 2A and 2B are schematic illustrations of a configuration of the speaker apparatus.
Figure 2B:
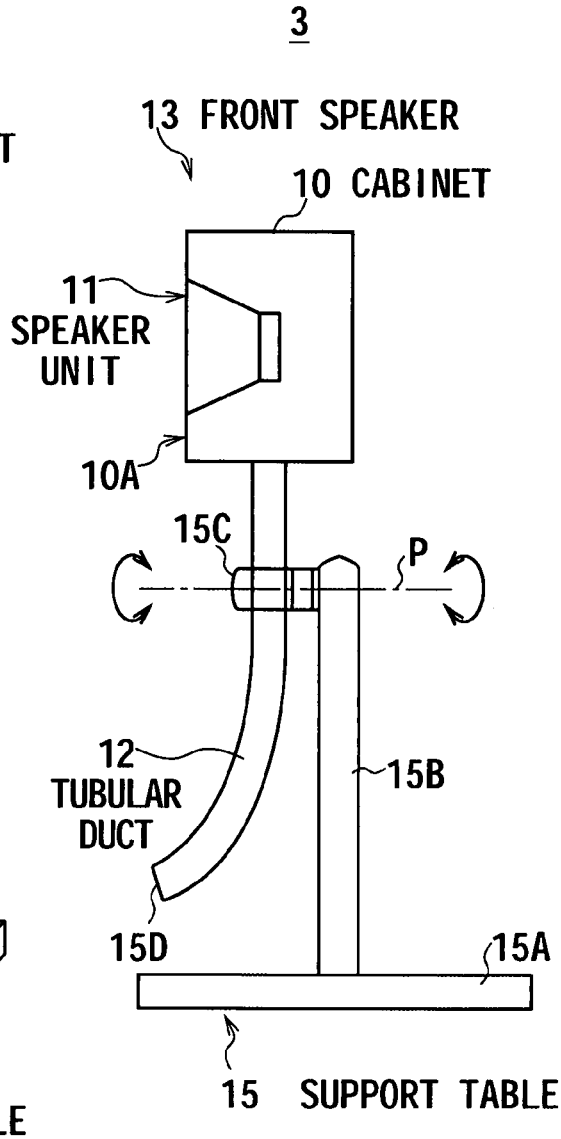

Referring to FIGS. 2A and 2B, the speaker apparatus 3 includes a front speaker 13 having a cabinet 10 that is equipped with a baffle plate 10A, a speaker unit 11 fitted to the baffle plate 10A so as to operate as electro-acoustic transducer for converting electric signals into sounds and a tubular duct 12 fitted to the cabinet 10 and extending from the lower surface of the cabinet 10 so as to show a predetermined diameter and a predetermined length and a support table 15 for supporting the tubular duct 12 of the front speaker 13.

The tubular duct 12 of the front speaker 13 is provided to enhance the bass reflex effect of the front speaker 13. It shows a bow-like profile that is curved toward the front end thereof and has an aperture 15D for outputting heavy low tones from the front end thereof.

The support table 15 includes a rod-shaped column 15B vertically extending upward from the substantially center part of the rectangular seat 15A thereof. The column 15B is provided at the front end part thereof with a rotary holding section 15C that supports the tubular duct 12 at a predetermined position and can be turned around axis P both clockwise and counterclockwise by 90 degrees.

The speaker apparatus 3 having the above described configuration can be used as speaker apparatus 3 for the left channel when the tubular duct 12 is turned clockwise around the axis P by means of the rotary holding section 15C, whereas it can be used as speaker apparatus 4 for the right channel when the tubular duct 12 is turned counterclockwise around the axis P.

Meanwhile, the tubular duct 12 of the front speaker 13 is made to show a predetermined diameter and a predetermined length so that a resonance circuit is formed by the cabinet 10 and the tubular duct 12 for the speaker unit 11 and the tubular duct 12 operates as a bass reflex duct that resonates at a predetermined frequency.

Thus, with the speaker system 1 of FIG. 1 formed by using two speaker apparatus according to the first embodiment of the present invention, the tubular ducts 12 of the speaker apparatus 3 and 4 are turned respectively clockwise and counterclockwise around the respective axes P by 90 degrees so that the aperture 15D of the tubular duct 12 of the speaker apparatus 3 for the left channel approaches the listener's left ear, while the aperture 15D of the tubular duct 12 of the speaker apparatus 4 for the right channel approaches the listener's right ear.

Additionally, with the speaker system 1 of FIG. 1, since the tubular duct 12 of the speaker apparatus 3 and that of the speaker apparatus 4 are made to show a bow-like profile, the apertures 15D formed at the front ends of the tubular ducts 12 are directed respectively toward the listener's left and right ears when the speaker system 1 is in use.

While both the tubular duct 12 of the speaker apparatus 3 and that of the speaker apparatus 4 are made to show a bow-like profile, but when the apparatus are not in use, the aperture 15D of each of the tubular ducts 12 is so devised that it does not come out from the corresponding end facet of the seat 15A of the support table 15 (FIG. 2B) and hence does not give any obstructive impression to the listener LNR.

Figure 3A:
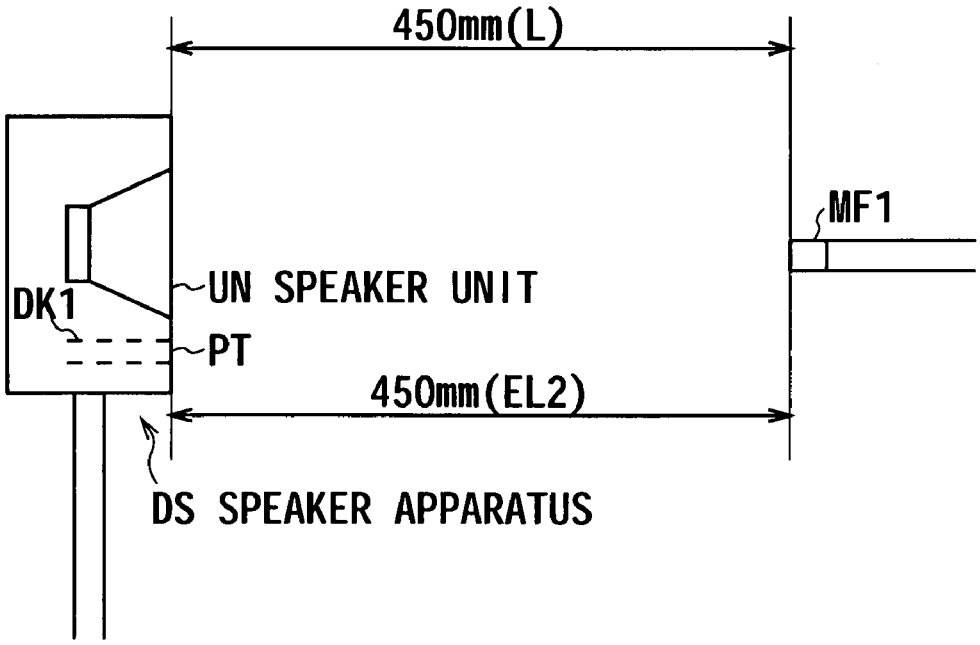
FIGS. 3A and 3B are schematic illustrations of the requirements to be met when measuring the effect of a speaker system.
Figure 3B:
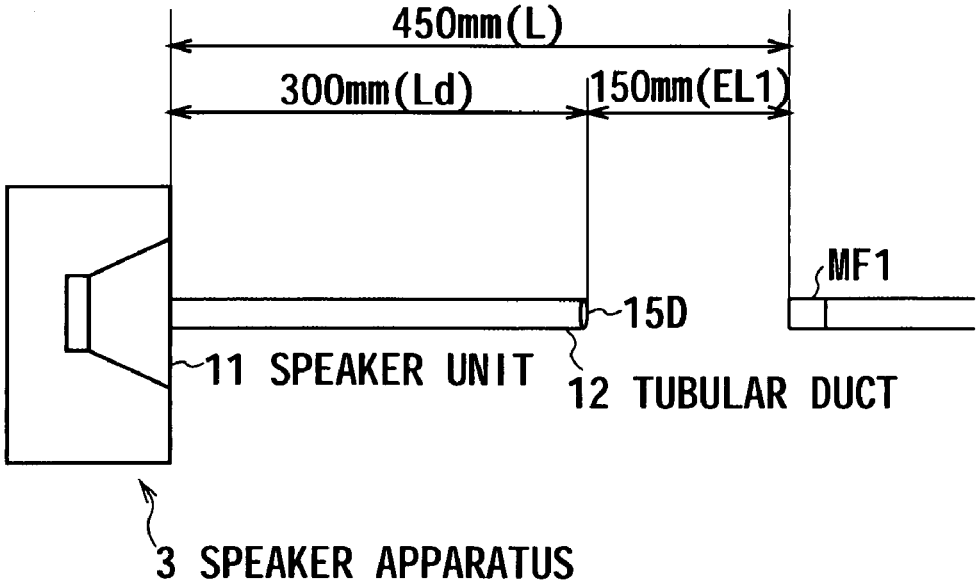

Now, the difference between a popular bass reflex type speaker apparatus DS as shown in FIG. 3A and the speaker apparatus 3 of the first embodiment that is provided with a tubular duct 12 will be discussed below from the viewpoint of frequency characteristics. The popular bass reflex type speaker apparatus DS is provided with a duct DK1 that is arranged only in the inside of the cabinet and not extended to the outside and the port PT thereof is located on the front plane of the speaker unit UN.

Both the frequency characteristics of the popular bass reflex type speaker apparatus DS and those of the speaker apparatus 3 according to the first embodiment of the present invention are observed under the conditions including the lowest resonance frequency f0: 250 Hz, effective oscillation radius A: 1.5 cm on the diaphragm of the speaker, the equivalent mass of the oscillation system Md: 0.8 g, the sharpness of resonance Q0: 0.8 and the volume of the cabinet V: 0.08 L, both of the speakers having an aperture ø: 9 mm and a length Ld: 300 mm.

When the distance L from the speaker unit UN to the microphone MF1 for measurement is made equal to 450 mm in the popular bass reflex type speaker apparatus DS, the distance EL2 from the port PT to the microphone MF1 for measurement is also equal to 450 mm. On the other hand, when the distance L from the speaker unit 11 to the microphone MF1 for measurement is made equal to 450 mm in the speaker apparatus 3 according to the first embodiment of the present invention, the distance EL1 from the aperture 15D of the tubular duct 12 to the microphone MF1 for measurement is 150 mm because the tubular duct 12 has a length Ld of 300 mm as pointed out above.

Figure 4:
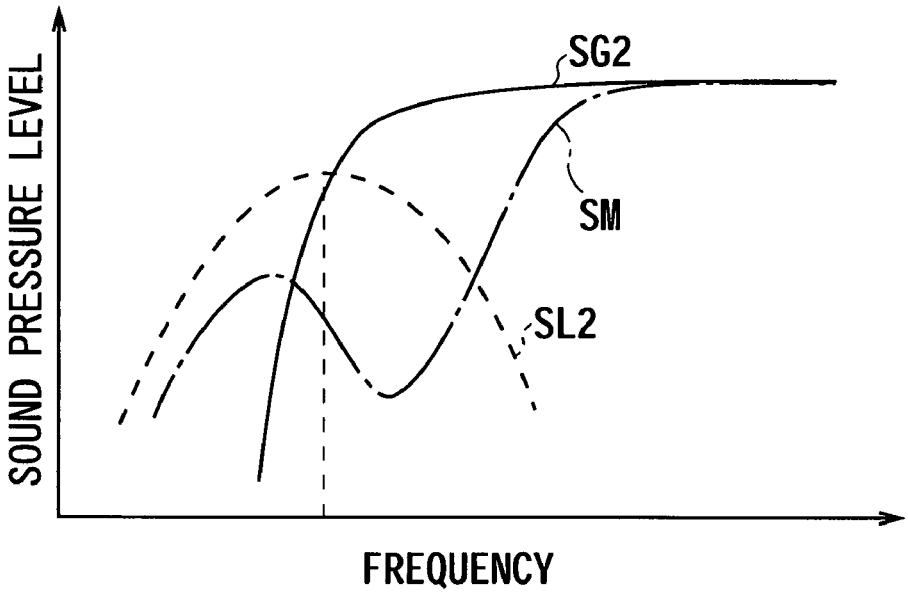
FIG. 4 is a graph illustrating the characteristic curves of the frequency characteristics of a known speaker apparatus.
Figure 5:
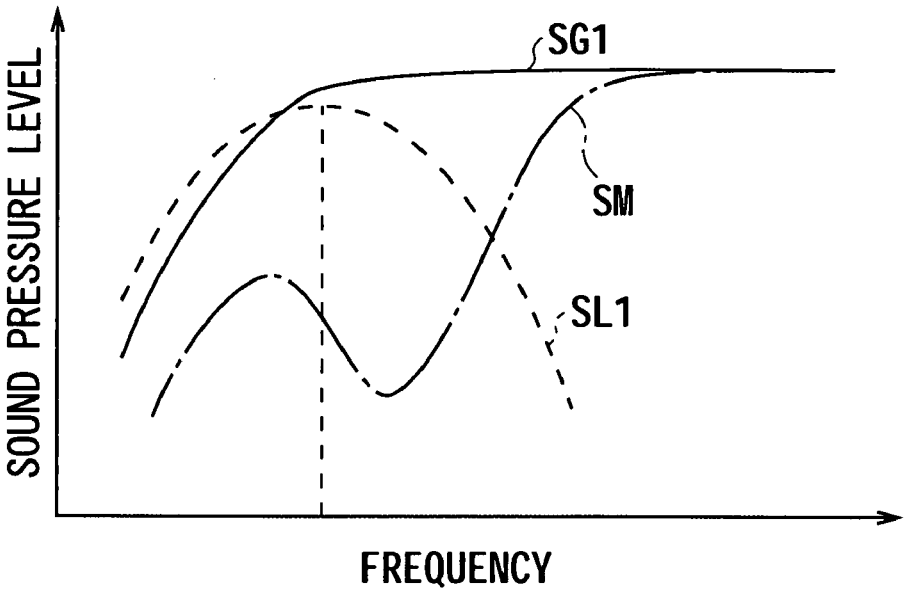
FIG. 5 is a graph illustrating the characteristic curves of the frequency characteristics of a speaker apparatus according to the first embodiment of the present invention.

As a result of the measurement, the frequency characteristics as shown in FIG. 4 were obtained for the sound output from the popular bass reflex type speaker apparatus DS, whereas the frequency characteristics as shown in FIG. 5 were obtained for the sound output from the speaker apparatus 3 according to the first embodiment of the present invention.

As seen from FIG. 4, the sound obtained by adding medium to high tones showing the frequency characteristic as indicated by characteristic curve SM and radiated from the speaker unit UN of the popular bass reflex type speaker apparatus DS and low tones showing the frequency characteristic as indicated by characteristic curve SL2 and radiated from the port PT for bass reflex gets to the ears of the listener LNR.

Thus, the listener of the popular bass reflex type speaker apparatus DS listens to the output sound where the sound pressure level of the low tone range of the characteristic curve SM is boosted to some extent as shown by the characteristic curve SG2, which is formed by synthetically combining the characteristic curve SM and the characteristic curve SL2.

On the other hand, as seen from FIG. 5, the sound obtained by adding medium to high tones showing the frequency characteristic as indicated by characteristic curve SM and radiated from the speaker unit 11 of the speaker apparatus 3 according to the first embodiment of the present invention and low tones showing the frequency characteristic as indicated by characteristic curve SL1 and radiated from the aperture 15D of the tubular duct 12 gets to the ears of the listener LNR.

Thus, the listener LNR of the speaker apparatus 3 according to the first embodiment of the present invention can listen to the output sound where the sound pressure level of the low tone range of the characteristic curve SM is boosted further down to the lower frequency band as shown by the characteristic curve SG1, which is formed by synthetically combining the characteristic curve SM and the characteristic curve SL1, if compared with the characteristic curve SG2 of the popular bass reflex type speaker apparatus DS.

Meanwhile, the pressure level is generally inversely proportional to the distance from the sound source. The path length EL2 from the bass reflex port PT to the microphone MF1 for measurement of the bass reflex type speaker apparatus DS and the path length EL1 from the tubular duct 12 of the speaker apparatus 3 according to the first embodiment of the present invention to the microphone MF1 for measurement show a relationship of the path EL1<the path EL2.

Thus, since the aperture 15D of the tubular duct 12 of the speaker apparatus 3 according to the first embodiment of the present invention is located closer to the ears of the listener LNR than the port PT of the bass reflex type speaker apparatus DS, the low tones radiated from the aperture 15D of the tubular duct 12 get to the ears of the listener LNR with a sound pressure level higher than the low tones radiated from the port PT of the bass reflex type speaker apparatus DS.

Figure 6:
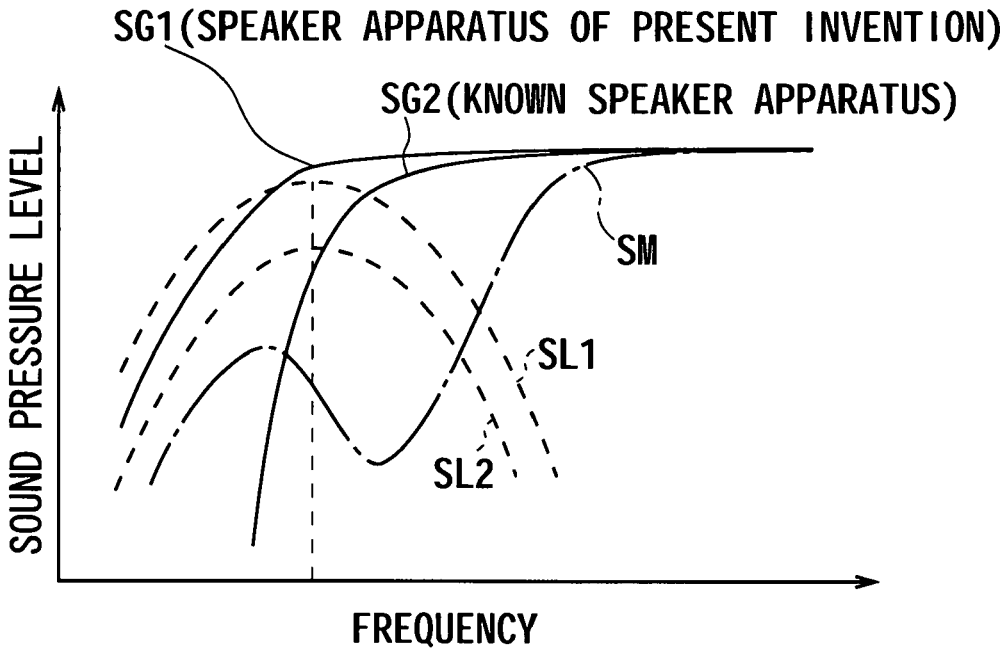
FIG. 6 is a graph illustrating the difference of frequency characteristics.
Figure 7:
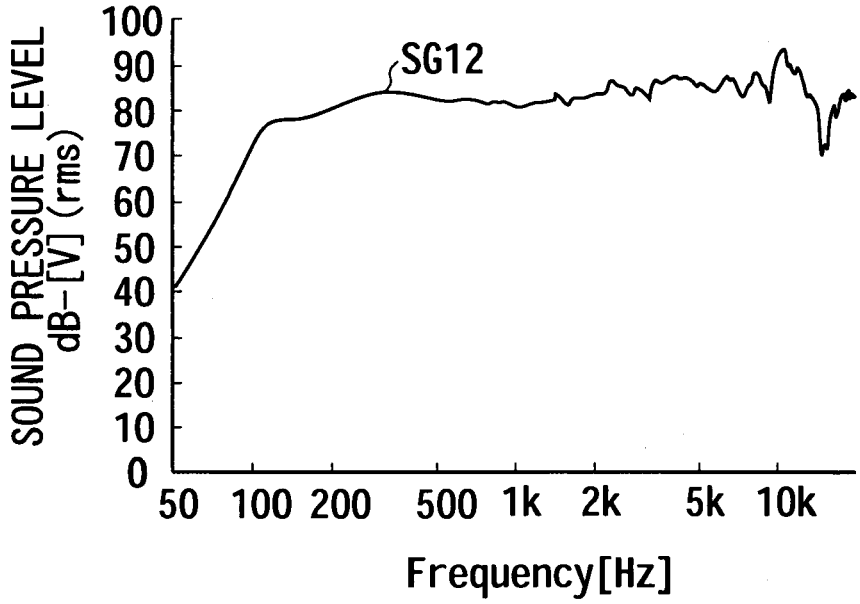
FIG. 7 is a graph of frequency characteristics illustrating the results obtained by actually observing a known speaker apparatus.
Figure 8:
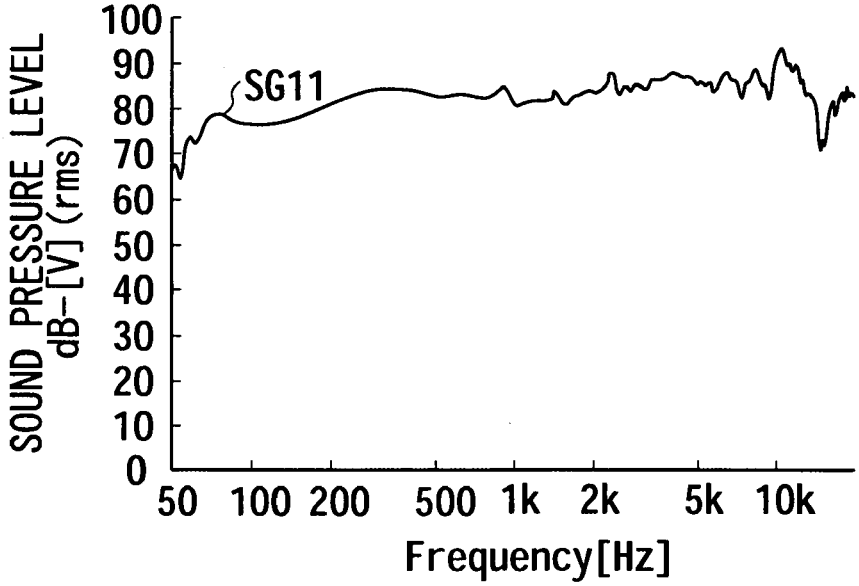
FIG. 8 is a graph of frequency characteristics illustrating the results obtained by actually observing a speaker apparatus according to the first embodiment of the present invention.

Therefore, as seen from FIG. 6 showing both the frequency characteristic curves of the known bass reflex type speaker apparatus DS shown in FIG. 4 and those of the speaker apparatus 3 according to the first embodiment of the present invention shown in FIG. 5, the characteristic curve SL1 of low tones radiated from the tubular duct 12 of the speaker apparatus 3 shows a high sound pressure level as a whole if compared with the characteristic SL2 of low tones radiated from the port PT of the bass reflex type speaker apparatus DS due to the relationship of the path length EL1<the path length EL2.

Then, as a result, as seen from the characteristic curve SG1 formed by synthetically combining the characteristic curve SM and the characteristic curve SL1, the sound radiated from the speaker apparatus 3 according to the first embodiment of the present invention provides the listener LNR with an output sound that shows a sound pressure level in the low tone range on the characteristic curve SM higher than the sound pressure level of the characteristic curve SG2 of the known bass reflex type speaker apparatus DS and sufficiently sustained down to a relatively low frequency band.

By comparing the characteristic curve SG1 and the characteristic curve SG2, it will be seen that the sound pressure level of the characteristic curve SG2 falls relatively steeply in the low tone range, whereas that of the characteristic curve SG1 falls only mildly in the low tone range.

Thus, if compared with the known bass reflex type speaker apparatus DS, the speaker apparatus 3 according to the first embodiment of the present invention can provide the listener LNR with an output sound showing a high sound pressure level over a wide frequency band including a sufficiently low tone range from the aperture 15D of the tubular duct 12.

As a matter of fact, the frequency characteristic curve SG12 (of the bass reflex type speaker apparatus DS) and the frequency characteristic curve SG11 (of the speaker apparatus 3 according to the first embodiment of the present invention) were obtained as a result of measuring the output sound of the known bass reflex type speaker apparatus DS and that of the speaker apparatus 3 according to the first embodiment of the present invention.

Like the logical frequency characteristics shown in FIG. 6, the characteristic curve SG11 of the speaker apparatus 3 according to the first embodiment of the present invention maintains a sufficiently high sound pressure level in the low tone range not higher than about 100 Hz if compared with the characteristic curve SG12 of the known bass reflex type speaker apparatus SD. In other words, the speaker apparatus 3 can provide the listener LNR with an output sound that sufficiently contains low tones if compared with the known bass reflex type speaker apparatus DS.

Thus, with the speaker system 1 shown in FIG. 1 realized by using speaker apparatus according to the first embodiment of the present invention, medium to high tones are radiated from the speaker unit 11 of the speaker apparatus 3 for the left channel and the speaker unit 11 of the speaker apparatus 4 for the right channel while low tones are radiated from the aperture 15D of the tubular duct 12 of the speaker apparatus 3 and also from the aperture 15D of the tubular duct 12 of the speaker apparatus 4 that are arranged in the vicinity of the ears of the listener LNR so that the listener LNR can listen to a high quality output sound that is highly stereophonic and sufficiently contains low tones.

In the above described arrangement, the tubular duct 12 of the speaker apparatus 3 of the speaker system 1 is held in a rotatable state by the column 15B by way the rotary holding section 15C arranged at a predetermined position so that it is possible to put the tubular duct 12 below the front speaker 13 when the speaker apparatus 3 is not in use but move the speaker unit 11 away from the listener LNR and bring the tubular duct 12 close to the corresponding ear of the listener LNR when the speaker apparatus 3 is in use.

Thus, the tubular duct 12 does not project forward from the seat 15A of the front speaker 13 when the speaker apparatus 3 is not being used for listening to a sound. In other words, it is possible to avoid a situation where the tubular duct 12 constitutes an obstacle to the listener LNR when the speaker apparatus 3 is not being used for listening to a sound by the above-described precautionary arrangement.

Additionally, with the speaker system 1, the front speakers 13 of the speaker apparatus 3 and 4 are held away from the listener LNR but the apertures 15D of the tubular ducts 12 are put in the vicinity of the ears of the listener LNR when it is being used so that the output sound can get to the listener LNR with a sufficiently high sound pressure level for the low tone range if compared with a speaker system formed by using known bass reflex type speaker apparatus DS where the speaker unit UN of each of the bass reflex type speaker apparatus DS and the port PT of the corresponding bass reflex duct DK1 are held on a same plane.

Furthermore, if the speaker apparatus 3 is only required to be equivalent to a known bass reflex type speaker apparatus DS in terms of the sound pressure level of the low tone range, the resonance frequency can be shifted to a lower frequency band by adjusting the diameter and the length of the tubular duct 12. Then, it is possible for the speaker apparatus 3 to provide the listener LNR with a high quality output sound whose sound pressure level does not fall over a wide frequency band if compared with the known bass reflex type speaker apparatus DS.

With the speaker system 1, since the tubular ducts 12 of the speaker apparatus 3 and 4 can be arranged in the vicinity of the ears of the listener LNR to transmit heavy low tones so that the listener LNR can listen to low tones with a sufficiently high sound pressure level without raising the overall volume level. Thus, it is possible to reliably reduce the noise level so much in the low tone range for the outside.

Note that, with the speaker system 1, the distance from the front speakers 13 to the listener and the distance from the apertures 15D of the tubular ducts 12 to the listener becomes approximately equal to each other as the listener is separated far away from the tubular ducts 12 of the speaker apparatus 3 and 4 to consequently fade out heavy low tones in the low frequency band below the resonance frequency that provides a bass reflex effect. Thus, it is possible to reduce the noise due to the leaking heavy low tones for the listener or listeners located behind the listener LNR.

Thus, with the above described arrangement of the speaker system 1 where the tubular ducts 12 of the speaker apparatus 3 and 4 are situated below the front speakers 13 when the system is not in use but the front speakers 13 of the speaker apparatus 3 and 4 are moved away from the listener LNR and the apertures 15D of the tubular ducts 12 are placed in the vicinity of the ears of the listener LNR when the system is in use, the tubular ducts 12 of the speaker apparatus 3 and 4 do not constitute any obstacle to the listener LNR when not listening to the sound output from the speaker apparatus and the listener LNR can listen to sufficiently heavy low tone when listening to the output sound.

(2) Second Embodiment

Figure 9:
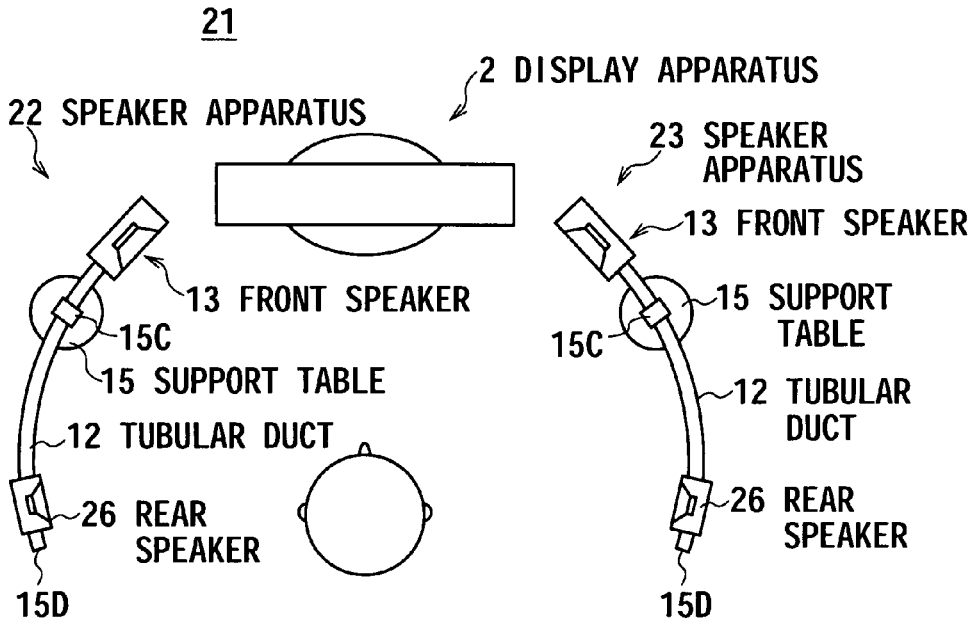
FIG. 9 is a schematic illustration of a speaker system according to the second embodiment of the present invention.

Referring to FIG. 9 where the components that correspond to those of FIG. 1 are denoted respectively by the same reference symbols, reference symbol 21 generally denotes a speaker system formed by using two speaker apparatus according to the second embodiment of the present invention. It includes a display apparatus 2, a speaker apparatus 22 for the left channel and a speaker apparatus 23 for the right channel, the speaker apparatus 22 and 23 being arranged at the opposite lateral sides of the display apparatus 2. The electric signals supplied from the display apparatus 2 respectively to the speaker apparatus 22 for the left channel and the speaker apparatus 23 for the right channel are converted into a sound so that the listener LNR can listen to the sound emitted from the speaker apparatus 22 and 23.

The speaker apparatus 22 for the left channel and the speaker apparatus 23 for the right channel basically have a same structure that is adapted to output sufficiently heavy low tones and provide high quality acoustic effects to the listener if compared with ordinary speaker apparatus.

Now, the specific configuration of the speaker apparatus 22 for the left channel and that of the speaker apparatus 23 for the right channel will be described. However, since the two speaker apparatus have the same structure, only the speaker apparatus 22 for the left channel will be described in detail below. In other words, the description of the speaker apparatus 23 for the right channel is omitted.

Figure 10A:
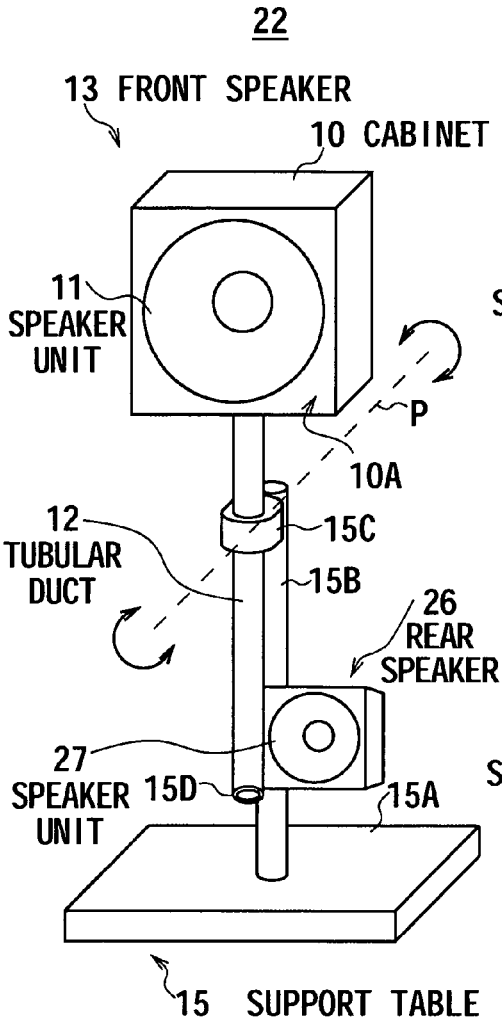
FIGS. 10A and 10B are schematic illustrations of a configuration of the speaker apparatus according to the second embodiment.
Figure 10B:
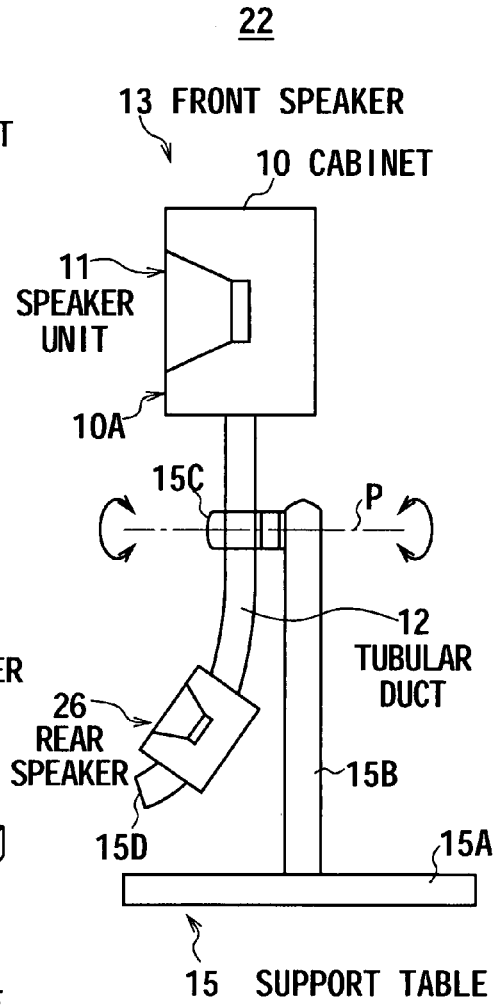

Referring to FIGS. 10A and 10B, the speaker apparatus 22 includes a front speaker 13 having a cabinet 10 that is equipped with a baffle plate 10A, a speaker unit 11 fitted to the baffle plate 10A so as to operate as electro-acoustic transducer for converting electric signals into sounds and a tubular duct 12 fitted to the cabinet 10 and extending from the lower surface of the cabinet 10 so as to show a predetermined diameter and a predetermined length, a rear speaker 26 fitted to the outer periphery of the front part of the tubular duct 12 of the front speaker 13 and a support table 15 for supporting the tubular duct 12.

The tubular duct 12 of the front speaker 13 is provided to enhance the bass reflex effect of the front speaker 13. It shows a bow-like profile that is curved toward the front end thereof and has an aperture 15D for outputting heavy low tones from the front end thereof.

The rear speaker 26 fitted to the outer periphery of the front part of the tubular duct 12 has a speaker unit 27 directed to the direction same as the speaker unit 11 of the front speaker 13. Note that the speaker unit 27 of the rear speaker 26 has a diameter smaller than the speaker unit 11 of the front speaker 13 and is operated to mainly output medium to high tones.

On the other hand, the support table 15 includes a rod-shaped column 15B vertically extending upward from the substantially center part of the rectangular seat 15A thereof. The column 15B is provided at the front end part thereof with a rotary holding section 15C that supports the tubular duct 12 at a predetermined position and can be turned around axis P both clockwise and counterclockwise by 90 degrees.

The speaker apparatus 22 having the above-described configuration can be used as speaker apparatus 3 for the left channel when the tubular duct 12 is turned clockwise around the axis P, whereas it can be used as speaker apparatus 4 for the right channel when the tubular duct 12 is turned counterclockwise around the axis P.

Meanwhile, the tubular duct 12 of the front speaker 13 is made to show a predetermined diameter and a predetermined length so that a resonance circuit is formed by the cabinet 10 and the tubular duct 12 for the speaker unit 11 and the tubular duct 12 operates as a bass reflex duct that resonates at a predetermined frequency.

Thus, with the speaker system 21 of FIG. 9 formed by using two speaker apparatus according to the second embodiment of the present invention, the tubular ducts 12 of the speaker apparatus 22 and 23 are turned respectively clockwise and counterclockwise around the respective axes P by 90 degrees so that the front speaker 13 of the speaker apparatus 22 for the left channel is moved away from the listener LNR and brought close to the display apparatus 2, while the front speaker 13 of the speaker apparatus 23 for the right channel is also moved away from the listener LNR and brought close to the display apparatus 2, whereas the aperture 15D of the tubular duct 12 of the speaker apparatus 22 for the left channel approaches the left ear of listener LNR, while the apparatus 15D of the tubular duct 12 of the speaker apparatus 23 for the right channel approaches the right ear of the listener LNR.

Note that, since the rear speakers 26 are fitted respectively to the front end of the tubular duct 12 of the speaker apparatus 22 for the left channel and the front end of the tubular duct 12 of the speaker apparatus 23 for the right channel, the rear speaker 26 of the speaker apparatus 22 for the left channel approaches the left ear of the listener LNR and the rear speaker 26 of the speaker apparatus 23 for the right channel approaches the right ear of the listener LNR.

Thus, the speaker system 21 formed by the speaker apparatus 22 for the left channel and the speaker apparatus 23 for the right channel is a four channel speaker system including front two channels and rear two channels.

The frequency characteristics of the speaker apparatus 22 of the speaker system 21 were observed and found to be substantially same as those of the speaker apparatus 3 of the first embodiment and hence differ from those of the popular bass reflex type speaker apparatus DS (FIG. 3A) as pointed out earlier.

Thus, the listener LNR of the speaker apparatus 22 according to the second embodiment of the present invention can listen to the output sound where the sound pressure level of the low tone range is boosted further down to the lower frequency band if compared with the popular bass reflex type speaker apparatus DS.

In the case of the speaker apparatus 22 according to the present invention in this speaker system again, the aperture 15D of the tubular duct 12 is located closer to the left ear of the listener LNR than the port PT of the bass reflex type speaker apparatus DS (FIG. 3A) so that the low tones transmitted through the inside of the tubular duct 12 and radiated from the aperture 15D of the tubular duct 12 get to the ears of the listener LNR with a higher sound pressure level than the bass reflex type speaker apparatus DS.

Then, as a result, the sound radiated from the speaker apparatus 22 according to the second embodiment of the present invention provides the listener LNR with an output sound that shows a sound pressure level in the low tone range higher than the sound pressure level of the known bass reflex type speaker apparatus DS and sufficiently sustained down to a relatively low frequency band.

Thus, with the speaker system 21 realized by using speaker apparatus according to the second embodiment of the present invention, medium to high tones are radiated from the front speaker 13 and the rear speaker 26 fitted respectively to the opposite ends of the tubular duct 12 of the speaker apparatus 22 for the left channel and the front speaker 13 and the rear speaker 26 fitted respectively to the opposite ends of the tubular duct 12 of the speaker apparatus 23 for the right channel while low tones are radiated from the aperture 15D of the tubular duct 12 of the speaker apparatus 22 and also from the aperture 15D of the tubular duct 12 of the speaker apparatus 23 that are arranged in the vicinity of the ears of the listener LNR so that the listener LNR can listen to a high quality output sound that gives him or her a sensation of being surrounded by sounds and is highly stereophonic, sufficiently containing low tones more than the speaker system 1 realized by applying the first embodiment of the invention.

Figure 11:
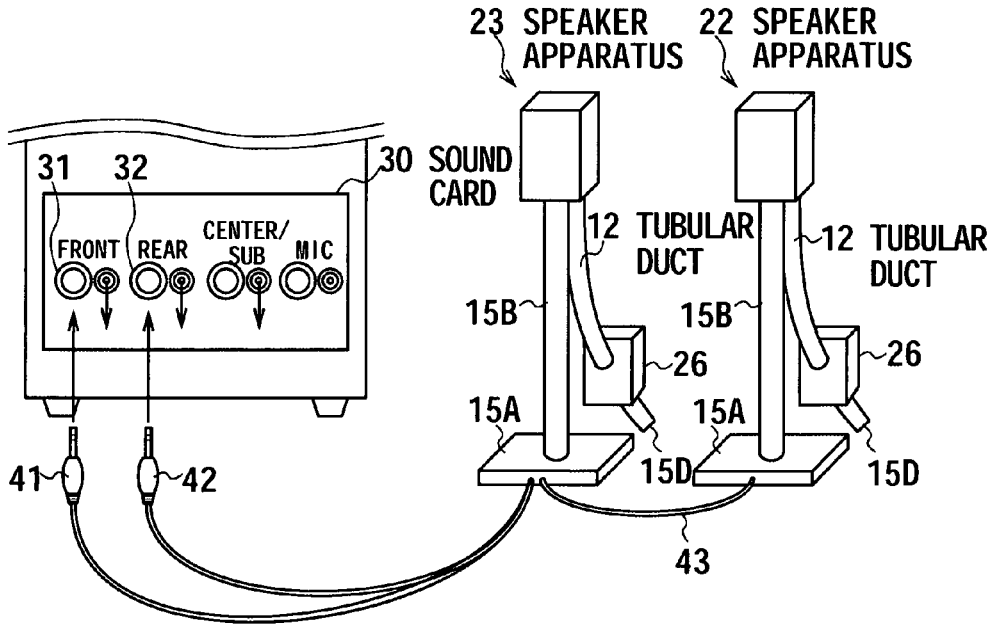
FIG. 11 is a schematic illustration of an exemplary connection arrangement.

FIG. 11 is a schematic illustration of an exemplary connection arrangement, where the speaker system 21 and a sound card of a persona computer are connected to each other. Referring to FIG. 11, the sound card 30 of the personal computer corresponds to the 5.1 ch surrounding effects and front speaker input terminal 41 and the rear speaker input terminal 42 of the speaker apparatus 23 for the right channel are connected respectively to the front LR audio signal output terminal 31 to be used for the front speaker 13 of the speaker apparatus 22 for the left channel and the front speaker 13 of the speaker apparatus 23 for the right channel and the rear LR audio signal output terminal 32 to be used for the rear speaker 26 of the speaker apparatus 22 for the left channel and the rear speaker 26 of the speaker apparatus 23 for the right channel.

Thus, the speaker apparatus 23 for the right channel receives the front LR audio signal and the rear LR audio signal supplied from the sound card 30 of the personal computer respectively by way of the front speaker input terminal 41 and the rear speaker input terminal 42 to the amplifier it contains and outputs the front L audio signal of the front LR audio signal and the rear L audio signal of the rear LR audio signal to the speaker apparatus 22 for the left channel by way of connection cable 43.

With this arrangement of the speaker system 21, the front speaker 13 of the speaker apparatus 23 for the right channel outputs the sound that corresponds to the front R audio signal and the rear speaker 26 of the speaker apparatus 23 outputs the sound that corresponds to the rear R audio signal, while the aperture 15D of the tubular duct 12 of the front speaker 13 outputs heavy low tones that correspond to the front R audio signal.

At the same time, with the speaker system 21, the front speaker 13 of the speaker apparatus 22 for the left channel outputs the sound that corresponds to the front L audio signal and the rear speaker 26 of the speaker apparatus 22 outputs the sound that corresponds to the rear L audio signal, while the aperture 15D of the tubular duct 12 of the front speaker 13 outputs heavy low tones that correspond to the front L audio signal.

Thus, with the speaker system 21, the heavy low tones output from the tubular ducts 12 of the speaker apparatus 22 for the left channel and the speaker apparatus 23 for the right channel can replace the heavy low tones output from the sub-woofer (not shown) for providing the 5.1 channel surrounding effects.

Additionally, with the speaker system 21, the medium to high tones output from the front speaker 13 of the speaker apparatus 22 for the left channel and the medium to high tones output from the front speaker 13 of the speaker apparatus 23 for the right channel can replace the medium to high tones to be output from the center speaker to provide the 5.1 channel surrounding effect when the former medium to high tones are localized substantially at the middle point between the left and right front speakers 13.

If the 5.1 channel surrounding arrangement is down-mixed to the 4 channel surrounding arrangement, the speaker system 21 can provide the listener LNR with the heavy low tones output from the speaker apparatus 22 for the left channel and the speaker apparatus 23 for the right channel with a high sound pressure level. Thus, the speaker system 21 can provide pseudo 5.1 channel surrounding effects that are close to the real 5.1 channel surrounding effects as acoustic effects.

In the above described arrangement, the tubular duct 12 of the speaker apparatus 22 of the speaker system 21 is held in a rotatable state by the column 15B by way the rotary holding section 15C arranged at a predetermined position so that it is possible to put the tubular duct 12 below the front speaker 13 when the speaker apparatus 22 is not in use but move the front speaker 13 and the rear speaker 26 respectively away from and close to the listener LNR and bring the aperture 15D of the tubular duct 12 to the vicinity of the corresponding ear of the listener LNR when the speaker apparatus 22 is in use.

Thus, the tubular duct 12 does not project forward from the seat 15A of the front speaker 13 when the speaker apparatus 22 is not being used for listening to a sound. In other words, it is possible to avoid a situation where the tubular duct 12 constitutes an obstacle to the listener LNR when the speaker apparatus 22 is not being used for listening to a sound by the above-described precautionary arrangement.

Additionally, with the speaker system 21, the front speakers 13 of the speaker apparatus 22 and 23 are held away from the listener LNR but the apertures 15D of the tubular ducts 12 are placed in the vicinity of the ears of the listener LNR when it is being used so that the output sound can get to the listener LNR with a sufficiently high sound pressure level for the low tone range if compared with a speaker system formed by using known bass reflex type speaker apparatus DS.

Furthermore, if the speaker apparatus 22 is only required to be equivalent to a known bass reflex type speaker apparatus DS in terms of the sound pressure level of the low tone range, the resonance frequency can be shifted to a lower frequency band by adjusting the diameter and the length of the tubular duct 12. Then, it is possible for the speaker apparatus 22 to provide the listener LNR with a high quality output sound whose sound pressure level does not fall over a wide frequency band if compared with the known bass reflex type speaker apparatus DS.

With the speaker system 21, since the tubular ducts 12 of the speaker apparatus 22 and 23 can be arranged in the vicinity of the ears of the listener LNR to output low tones so that the listener LNR can listen to low tones with a sufficiently high sound pressure level without raising the overall volume level. Thus, it is possible to reliably reduce the noise level so much in the low tone range for the outside.

Note that, with the speaker system 21, the distance from the speaker units 11 of the speaker apparatus 22 and 23 to the listener and the distance from the apertures 15D of the tubular ducts 12 to the listener becomes approximately equal to each other as the listener is separated far away from the tubular ducts 12 of the speaker apparatus 22 and 23 to consequently fade out heavy low tones in the low frequency band below the resonance frequency that provides a bass reflex effect. Thus, it is possible to reduce the noise due to the leaking heavy low tones for the listener or listeners located behind the listener LNR.

Thus, with the above described arrangement of the speaker system 21 where the tubular ducts 12 of the speaker apparatus 22 and 23 are situated below the front speakers 13 when the system is not in use but the front speakers 13 of the speaker apparatus 22 and 23 are moved away from the listener LNR and the apertures 15D of the tubular ducts 12 are placed in the vicinity of the ears of the listener LNR while the rear speakers 26 are brought close to the listener LNR when the system is in use, the tubular ducts 12 of the speaker apparatus 22 and 23 do not constitute any obstacle to the listener LNR when not listening to the sound output from the speaker apparatus and the listener LNR can listen to sufficiently heavy low tone when listening to the output sound.

(3) Other Arrangements (3-1) Liquid Crystal Display

Figure 12B:
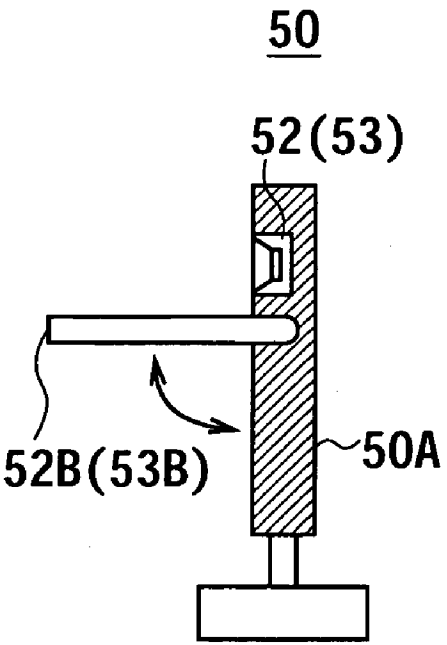
FIGS. 12A and 12B are schematic illustrations of a liquid crystal display as another configuration example.
Figure 12A:
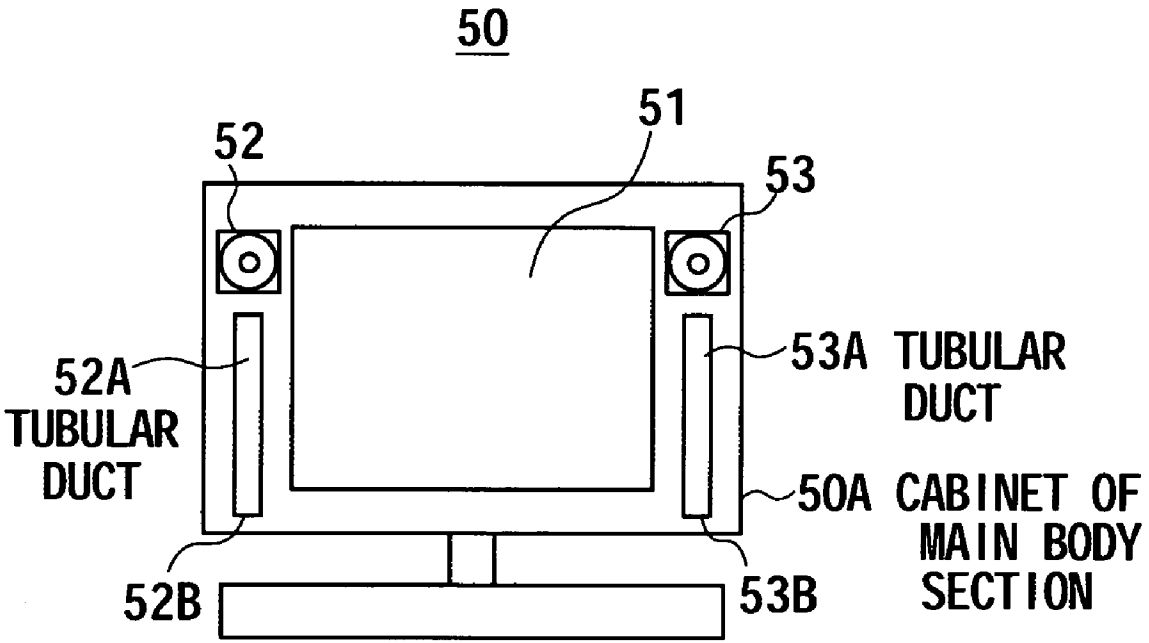

As shown in FIGS. 12A and 12B, reference symbols 50 generally denotes a liquid crystal display apparatus that incorporates speaker apparatus 52 and 53 respectively at upper left and right positions near the liquid display screen 51 that is fitted to the cabinet 50A of the main body section. Tubular ducts 52A, 53A having a profile of a rectangular parallelepiped with a predetermined width and a predetermined length are also fitted the cabinet 50A at respective positions located below the speaker apparatus 52 and 53. Like the bass reflex ducts 12 of the above-described first embodiment, the tubular ducts 52A and 53A operate as bass reflex ducts that resonate at a predetermined frequency.

The tubular ducts 52A and 53A are rotatably fitted to the respective speaker apparatus 52 and 53 in such away that can be turned upward from below. When not in use, the tubular ducts 52A and 53A are contained so as not to project forward from the front surface of the liquid crystal display screen 51. In other words, they project forward from the front surface of the liquid crystal display screen 51 only when they are put to use.

With such an arrangement, in the liquid crystal display apparatus 50, while the speaker apparatus 52 and 53 are arranged at the plane same as that of the liquid crystal display screen 51, the tubular ducts 52A and 53A project forward from the liquid crystal display screen 51 so that the apertures 52B and 53B of the tubular ducts 52A and 53A are located in the vicinity of the respective ears of the listener (not shown) and hence provide the listener with the output sound showing a high sound pressure level in the low tone range.

Thus, with the liquid crystal display apparatus 50, the listener LNR can listen to sufficiently heavy low tones with a sufficiently high sound pressure level without unnecessarily raising the overall volume level because the tubular ducts 52A and 53A of the speaker apparatus 52 and 53 are adapted to output heavy low tones. Therefore, it is possible to reliably reduce the noise level so much in the low tone range for the outside.

Additionally, since the liquid crystal display apparatus 50 includes a liquid crystal display screen 51 and speaker apparatus 52 and 53 as integral components thereof and hence the tubular ducts 52A and 53A are contained in the cabinet 50A so as not to project forward from the front surface of the liquid crystal display screen 51 when they are not in use, it is possible to avoid a situation where the tubular ducts 52A and 52B constitute obstacles to the listener LNR.

(3-2) Portable DVD Radio Player

Figure 13B:
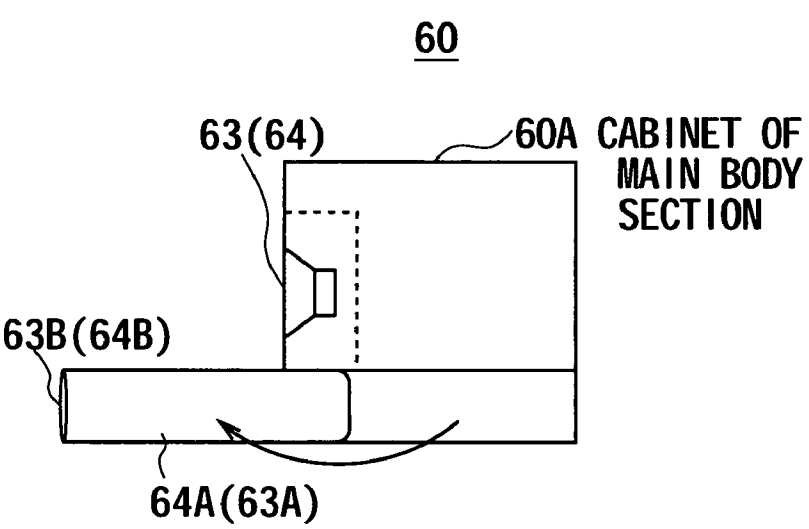
FIGS. 13A and 13B are schematic illustrations of DVD radio player as another configuration example.
Figure 13A:
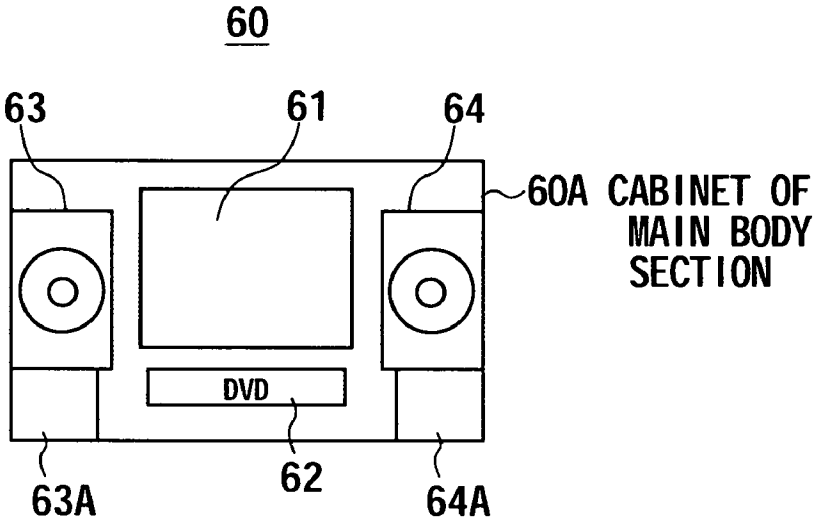

As shown in FIGS. 13A and 13B, reference symbol 60 generally denotes a portable DVD (digital versatile disc) radio player that includes a cabinet 60A of the main body section, a liquid crystal display screen 61 arranged at the center of the front side of the cabinet 60A, a DVD insertion slot 62 also arranged at the front center of the cabinet 60A and speaker apparatus 63 and 64 arranged respectively at the left and right sides of the cabinet 60A.

Tubular ducts 63A and 64A are rotatably fitted to respective lower parts of the cabinet 60A of the portable DVD player 60 that holds the speaker apparatus 63 and 64 in such a way that they can rotate horizontally within an angular range of 180 degrees. The tubular ducts 63A and 64A are adapted to operate as bass reflex ducts that resonate at a predetermined frequency as in the case of the bass reflex ducts 12 of the above described first embodiment.

In the portable DVD radio player 60, the tubular ducts 63A and 64A of the speaker apparatus 63 and 64*b* are fitted in such a way that they are turned toward the front side of the liquid crystal display screen 61 as they are horizontally rotated from the lateral sides of the main body section by 180 degrees. Thus, the tubular ducts 63A and 64A are contained in the main body section so as not to project from the lateral surfaces of the main body section when they are not in use but project forward from the front surface of the liquid crystal display screen 61 when they are put to use.

When the tubular ducts 63A and 64A are turned toward the front side of the liquid crystal display screen 61, the apertures 63B and 64B of the tubular ducts 63A and 64A are located in the vicinity of the ears of the listener (not shown) standing or sitting right in front so that the output sound can get to the listener with a sufficiently high sound pressure level for the low tone range.

Thus, with the portable DVD radio player 60, the tubular ducts 63A and 64A of the speaker apparatus 63 and 64 can output heavy low tones so that the listener can listen to heavy low tones with a sufficiently high soundpressure level without raising the overall volume level. Thus, it is possible to reliably reduce the noise level so much in the low tone range for the outside.

Additionally, since the portable DVD radio player 60 includes a liquid crystal display screen 61, a DVD insertion slot 62 and speaker apparatus 63 and 64 as integral components thereof and hence the tubular ducts 63A and 64A are contained in the cabinet 60A so as to project neither forward from the front surface of the liquid crystal display screen 61 nor sideward from the lateral surfaces of the cabinet 60A when they are not in use, it is possible to avoid a situation where the tubular ducts 63A and 64A constitute obstacles to the listener LNR.

Figure 14B:
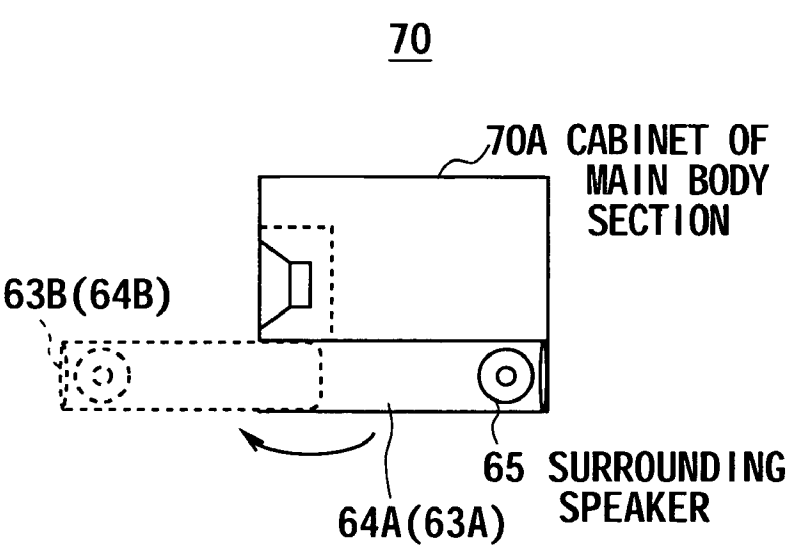
FIGS. 14A and 14B are schematic illustrations of DVD radio player as another configuration example.
Figure 14A:
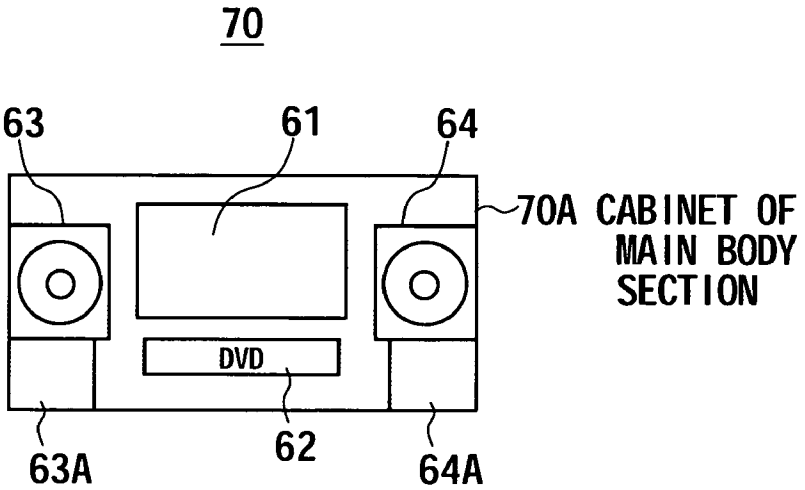

FIGS. 14A and 14B are schematic illustrations of another portable DVD radio player or portable DVD player (2). In FIGS. 14A and 14B, the components same as or similar to those of the apparatus of FIGS. 13A and 13B are denoted respectively by the same reference symbols. Referring to FIGS. 14A and 14B, reference symbol 70 generally denotes this portable DVD radio player which is structurally basically same as the above described portable radio DVD radio player 60 and includes a cabinet 70A of the main body section, a liquid crystal display screen 61 arranged at the center of the front side of the cabinet 70A, a DVD insertion slot 62 also arranged at the front center of the cabinet 70A and speaker apparatus 63 and 64 arranged respectively at the left and right sides of the cabinet 70A. This portable DVD radio player 70 differs from the portable DVD radio player 60 only in that surrounding speakers 65 are arranged respectively at the front end parts of the tubular ducts 63A and 64A of the speaker apparatus 63 and 64.

When in use, the portable DVD radio player 70 gives rise to a bass reflex effect by means of the tubular ducts 63A and 64A of the speaker apparatus 63 and 64 like the portable DVD radio player 60 and additionally, since the listener (not shown) is interposed between the two surrounding speakers 65 arranged respectively at the front end parts of the tubular ducts 63A and 64A, he or she can listen to an output sound that shows a high sound pressure level in the low tone range and is provided with a sound field space that gives the listener an enhanced sensation of being surrounded by sounds.

(3-3) Cradle Apparatus

Figure 15A:
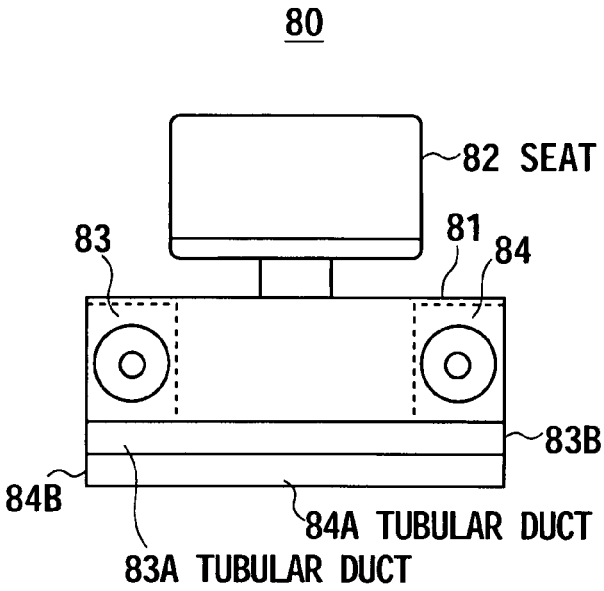
FIGS. 15A, 15B and 15C are schematic illustrations of cradle apparatus as another configuration example.
Figure 15B:
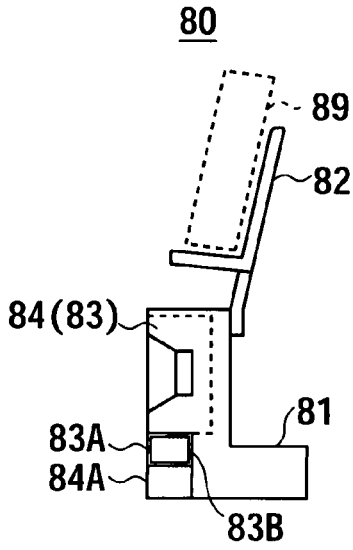
Figure 15C:
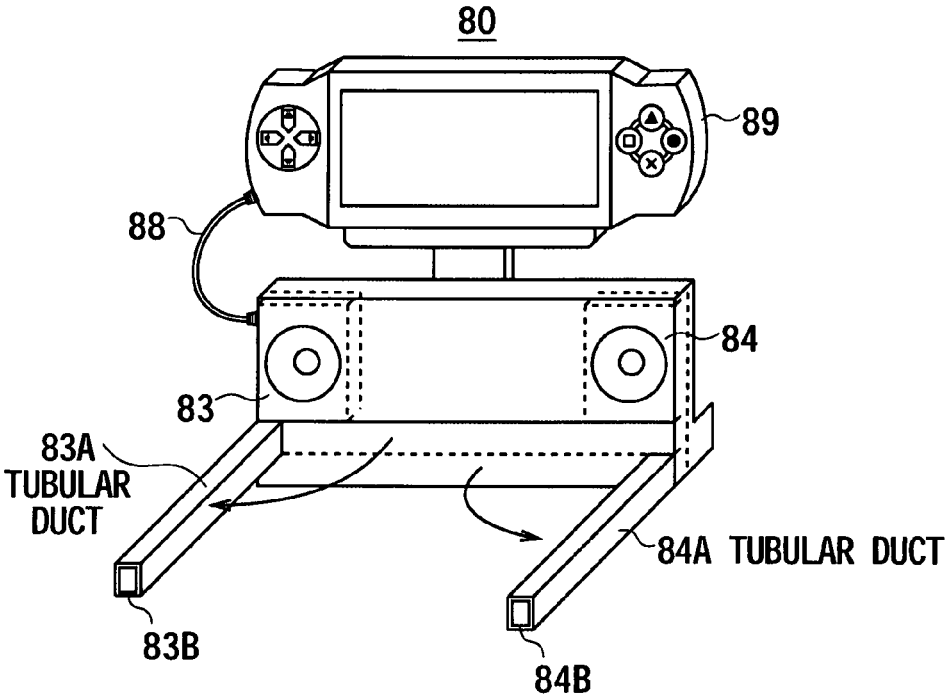

Referring to FIGS. 15A, 15B and 15C, reference symbol 80 generally denotes a cradle apparatus that includes a cabinet 81 of the main body section and a seat 82 projecting upward from the substantial center of the cabinet 81. For example, a portable game machine, digital music player or an electronic appliance 89 such as a portable telephone set that can output audio signals may be placed on the seat 82.

A left channel speaker apparatus 83 and a right channel speaker apparatus 84 are arranged at respective lateral positions of the cabinet 81 of the cradle apparatus 80. Thus, the electronic appliance 89 put on the seat 82 is connected to the cabinet 81 typically by way of a USB (universal serial bus) cable 88 so that the audio signal from the electronic appliance 89 is input to the amplifier in the cabinet 81 by way of the USB cable 88 and the sound that corresponds to the audio signal is output from the speaker apparatus 83 and 84.

Tubular ducts 83A and 84A are rotatably fitted to respective lower parts of the cabinet of the cradle apparatus 80 that hold the speaker apparatus 83 and 84 in such a way that they can rotate horizontally (in the directions indicated by arrows in FIG. 15C) within an angular range of 90 degrees. The tubular duct 83A and 84A are adapted to operate as bass reflex ducts that resonate at a predetermined frequency as in the case of the bass reflex ducts 12 of the above described first embodiment.

With the cradle apparatus 80, the tubular ducts 83A and 84A of the speaker apparatus 83 and 84 are collapsed and contained in the cabinet 81 so that they may not project from the front surface of the cabinet 81 when they are not in use. The tubular ducts 83A and 84A project from the front surface of the cabinet 81 toward the listener only when the cradle apparatus 80 is in use.

Then, the apertures 83B and 84B of the tubular duct 83A and 84A of the speaker apparatus 83 and 84 of the cradle apparatus 80 are placed in the vicinity of the ears of the listener (not shown) when the cradle apparatus 80 is being used so that the listener can listen to an output sound that shows a high sound pressure level in the low tone range.

Thus, with the cradle apparatus 80, the listener can listen to sufficiently heavy low tones with a sufficiently high sound pressure level without unnecessarily raising the overall volume level because the tubular ducts 83A and 84A of the speaker apparatus 83 and 84 are adapted to output heavy low tones. Therefore, it is possible to reliably reduce the noise level so much in the low tone range for the outside.

Additionally, since the cradle apparatus 80 includes a cabinet 81, a seat 82 and speaker apparatus 83 and 84 as integral components thereof and hence the tubular ducts 83A and 84A are contained in the cabinet 81 so as not to project forward from the front surface of the cabinet 81 when they are not in use, it is possible to avoid a situation where the tubular ducts 83A and 84A constitute obstacles to the listener.

Figure 16A:
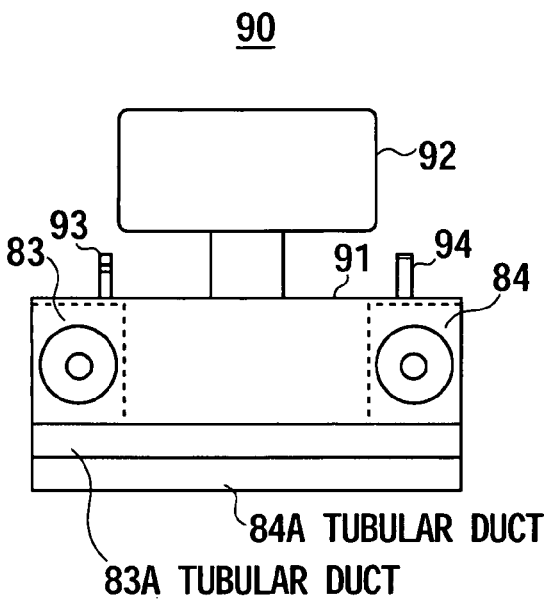
FIGS. 16A and 16B are schematic illustrations of cradle apparatus as another configuration example.
Figure 16B:
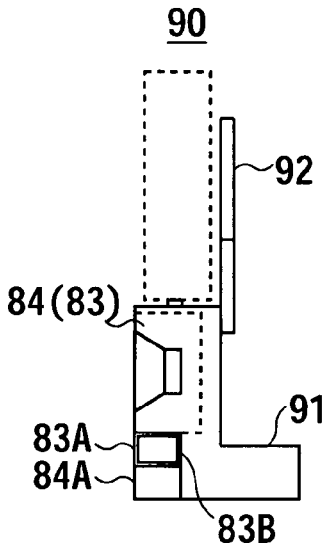

In FIGS. 16A and 16B, the components same as or similar to those of the apparatus of FIGS. 15A, 15B and 15C are denoted respectively by the same reference symbols. Referring to FIGS. 16A and 16B, reference symbol 90 generally denotes the cradle apparatus. A back holder 92 projects upward from the center of the cabinet 91 of the main body section and a signal input terminal 93 and a DC power supply terminal 94 project from the top surface of the cabinet 91.

Thus, the cradle apparatus 90 operates as docking station when the signal input terminal 93 and the DC power supply terminal 94 are connected respectively to the audio signal output jack and the DC power supply input jack (not shown) of the electronic appliance 89, which may be a portable game machine, and the electric appliance 89 is held to the back holder 92 at the back thereof to mechanically and electrically connect the cradle apparatus 90 and the electronic appliance 89.

A left channel speaker apparatus 83 and a right channel speaker apparatus 84 are arranged at respective lateral positions of the cabinet 91 of the cradle apparatus 90. Thus, the audio signal from the electronic appliance 89 that is connected to the cradle apparatus 90 by way of the signal input terminal 93 and the DC power supply terminal 94 is input to the amplifier in the cabinet 91 and the sound that corresponds to the audio signal is output from the speaker apparatus 83 and 84.

Tubular ducts 83A and 84A are rotatably fitted to respective lower parts of the cabinet of the cradle apparatus 90 that hold the speaker apparatus 83 and 84 in such a way that they can rotate horizontally (in the directions indicated by arrows in FIG. 15C) within an angular range of 90 degrees. The tubular ducts 83A and 84A are adapted to operate as bass reflex ducts that resonate at a predetermined frequency as in the case of the bass reflex ducts 12 of the above described first embodiment.

With the cradle apparatus 90, the tubular ducts 83A and 84A of the speaker apparatus 83 and 84 are collapsed and contained in the cabinet 91 so that they may not project from the front surface of the cabinet 91 when they are not in use. The tubular ducts 83A and 84A project from the front surface of the cabinet 91 toward the listener only when the cradle apparatus 90 is in use.

Then, the apertures 83B and 84B of the tubular ducts 83A and 84A of the speaker apparatus 83 and 84 of the cradle apparatus 90 are placed in the vicinity of the ears of the listener (not shown) when the cradle apparatus 90 is being used so that the listener can listen to an output sound that shows a high sound pressure level in the low tone range.

Thus, with the cradle apparatus 90, the listener can listen to sufficiently heavy low tones with a sufficiently high sound pressure level without unnecessarily raising the overall volume level because the tubular ducts 83A and 84A of the speaker apparatus 83 and 84 are adapted to output heavy low tones. Therefore, it is possible to reliably reduce the noise level so much in the low tone range for the outside.

Additionally, since the cradle apparatus 90 includes a cabinet 91, a back holder 92 and speaker apparatus 83 and 84 as integral components thereof and hence the tubular ducts 83A and 84A are contained in the cabinet 91 so as not to project forward from the front surface of the cabinet 91 when they are not in use, it is possible to avoid a situation where the tubular ducts 83A and 84B constitute obstacles to the listener.

Figure 17A:
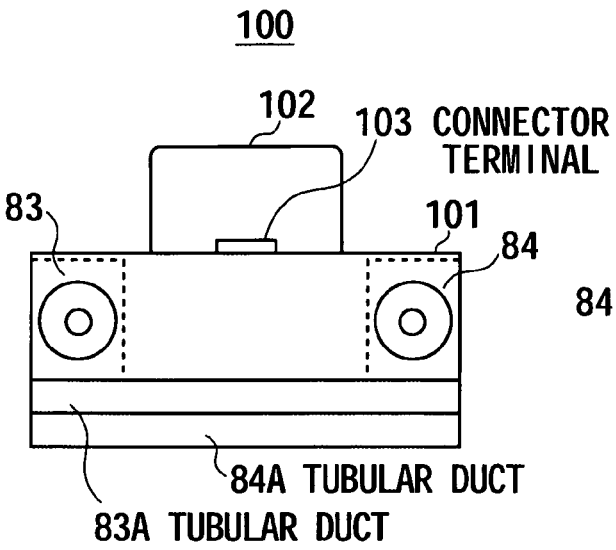
FIGS. 17A and 17B are schematic illustrations of cradle apparatus as another configuration example.
Figure 17B:
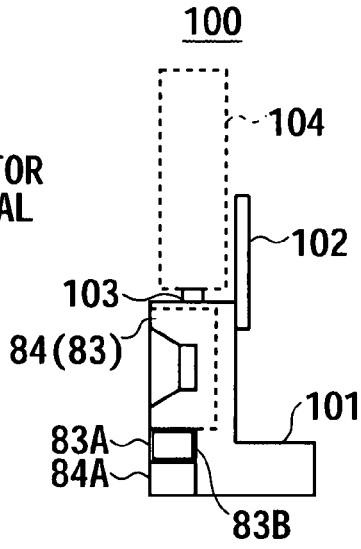

In FIGS. 17A and 17B, the components same as or similar to those of the apparatus of FIGS. 15A, 15B and 15C are denoted respectively by the same reference symbols. Referring to FIGS. 17A and 17B, reference symbol 100 generally denotes the cradle apparatus. A back holder 102 projects upward from the center of the cabinet 101 of the main body section. A connector terminal 103 also projects upward substantially from the center of the top surface of the cabinet 101.

Thus, the cradle apparatus 100 operates as docking station when the connector terminal 103 arranged on the top surface of the cabinet 101 is connected to the output terminal (not shown) of the electronic appliance 104, which may be a portable telephone set or a digital audio player, and the electric appliance 104 is held to the back holder 102 at the back thereof to mechanically and electrically connect the cradle apparatus 100 and the electronic appliance 104.

A left channel speaker apparatus 83 and a right channel speaker apparatus 84 are arranged at respective lateral positions of the cabinet 101 of the cradle apparatus 100. Thus, the audio signal from the electronic appliance 104 that is connected to the cradle apparatus 100 by way of the connector terminal 103 is input to the amplifier in the cabinet 101 and the sound that corresponds to the audio signal is output from the speaker apparatus 83 and 84.

Tubular ducts 83A and 84A are rotatably fitted to respective lower parts of the cabinet of the cradle apparatus 100 that hold the speaker apparatus 83 and 84 in such a way that they can rotate in the directions indicated by arrows within an angular range of 90 degrees. The tubular ducts 83A and 84A are adapted to operate as bass reflex ducts that resonate at a predetermined frequency as in the case of the bass reflex ducts 12 of the above described first embodiment.

With the cradle apparatus 100, the tubular ducts 83A and 84A of the speaker apparatus 83 and 84 are collapsed and contained in the cabinet 101 so that they may not project from the front surface of the cabinet 101 when they are not in use. The tubular ducts 83A and 84A project from the front surface of the cabinet 101 toward the listener only when the cradle apparatus 100 is in use.

Then, the apertures 83B and 84B of the tubular ducts 83A and 84A of the speaker apparatus 83 and 84 of the cradle apparatus 100 are placed in the vicinity of the ears of the listener (not shown) when the cradle apparatus 100 is being used so that the listener can listen to an output sound that shows a high sound pressure level in the low tone range.

Thus, with the cradle apparatus 100, the listener can listen to sufficiently heavy low tones with a sufficiently high sound pressure level without unnecessarily raising the overall volume level because the tubular ducts 83A and 84A of the speaker apparatus 83 and 84 are adapted to output heavy low tones. Therefore, it is possible to reliably reduce the noise level so much in the low tone range for the outside.

Additionally, since the cradle apparatus 100 includes a cabinet 101, a back holder 102, a connector terminal 103 and speaker apparatus 83 and 84 as integral components thereof and hence the tubular ducts 83A and 84A are contained in the cabinet 101 so as not to project forward from the front surface of the cabinet 101 when they are not in use, it is possible to avoid a situation where the tubular ducts 83A and 84B constitute obstacles to the listener.

(4) Other Embodiments

Figure 18A:
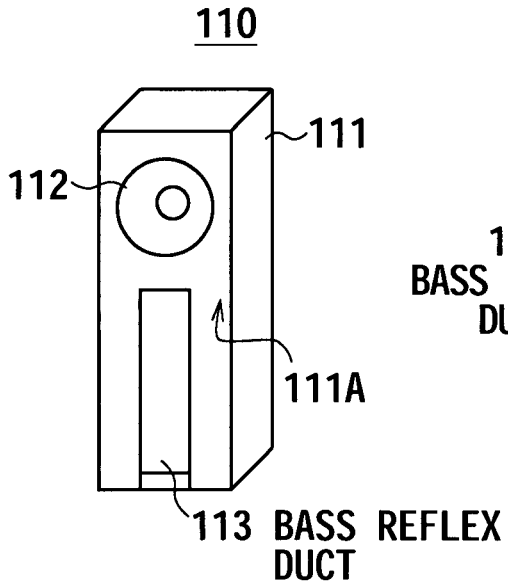
FIGS. 18A and 18B are schematic illustrations of speaker apparatus that is another embodiment of the present invention.
Figure 18B:
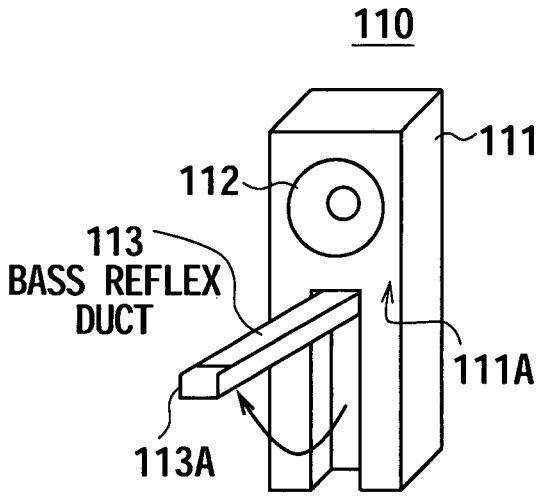
Figure 19A:
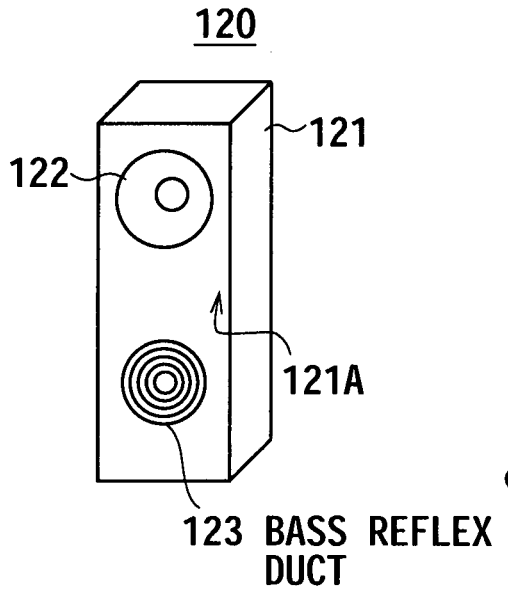
FIGS. 19A and 19B are schematic illustrations of speaker apparatus that is still another embodiment of the present invention.
Figure 19B:
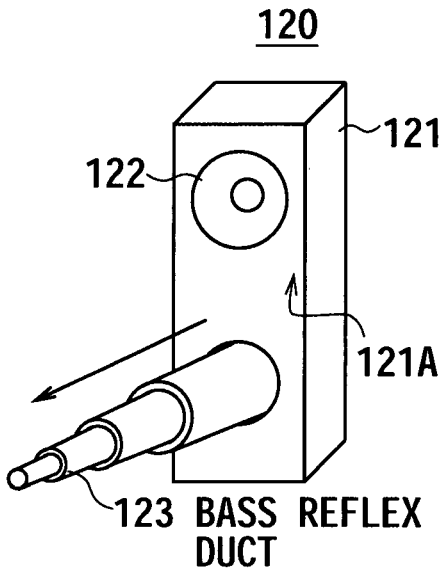

While the tubular duct 12 is rotatably supported by a rotary holding section 15C arranged at the front end of the column 15B of the support table 15 for each of the speaker apparatus 3 and 22 in the first and second embodiments, the present invention is by no means limited to such an arrangement. As shown in FIGS. 18A and 18B, it may alternatively be so arranged that a speaker unit 112 is fitted to the baffle plate 111A of the cabinet section 111 and a collapsible bass reflex duct 113 is fitted below the speaker unit 112 so as to be contained in the cabinet section 111 for each speaker apparatus 110. As shown in FIGS. 19A and 19B, it may still alternatively be so arranged that a speaker unit 122 is fitted to the baffle plate 121A of the cabinet section 121 and a telescopic bass reflex duct 123 is fitted below the speaker unit 122 for each speaker apparatus 120.

Then, the bass reflex ducts 131 and 123 do not project from the front surfaces of the respective baffle plates 111A and 121A of the speaker apparatus 110 and 120 when they are not in use to aesthetically improve the appearance of the speaker apparatus.

Figure 20:
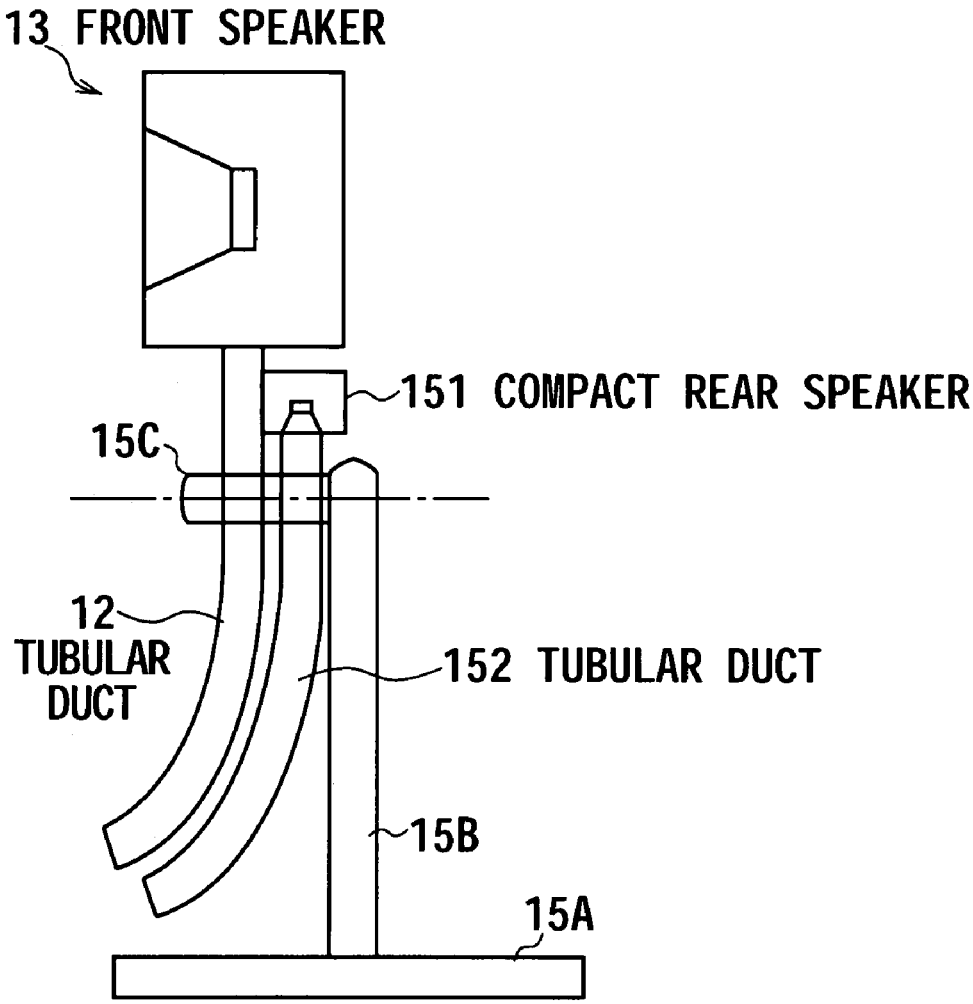
FIG. 20 is a schematic illustration of speaker apparatus that is a further embodiment of the present invention.

While a rear speaker 26 is fitted to a front end part of each of the tubular duct 12 of the above described second embodiment, the present invention is by no means limited thereto and it may alternatively be so arranged that a compact rear speaker 151 is placed near the front speaker and both a tubular duct 152 projecting from the front surface 13 of the compact rear speaker 151 and the tubular duct 12 of the front speaker 13 are rotatably held by the rotary holding section 15C as shown in FIG. 20.

While the rear speaker 26 is fitted to a front end part of the tubular duct 12 for each speaker apparatus in the above described second embodiment, the present invention is by no means limited thereto and the tubular duct 12 may alternatively be made to project from the bottom of the cabinet of the rear speaker 26.

The tubular ducts 52A and 53A of the above described liquid crystal display apparatus 50 have a profile of a rectangular parallelepiped, the present invention is by no means limited thereto and the tubular ducts may alternatively have a bow-like profile. Then, the front end apertures of the tubular ducts are directed toward the respective ears of the listener LNR so that the listener can listen to an output sound that shows a high sound pressure level in the low tone range.

A speaker unit and a speaker apparatus according to the embodiments of the present invention can find applications in stand alone type speakers arranged in private houses, movie theaters and other theaters as well as portable radio cassette players and audio apparatus.

It should be understood by those skilled in the art that various modifications, combinations, sub-combinations and alterations may occur depending on design requirements and other factors insofar as they are within the scope of the appended claims or the equivalents thereof.

What is claimed is:

1. A speaker apparatus comprising:

a speaker;

a tubular duct extended in order to make sound generated inside of a cabinet of the speaker get to a vicinity of a listener's ears; and a support mechanism fitted to a vertical support, wherein the support mechanism that allows the tubular duct to be rotated clockwise or counterclockwise about a horizontal-axis in order to bring a front end aperture of the tubular duct toward the vicinity of the ears of the listener.

2. The apparatus according to claim 1, wherein the speaker is moved away from the vicinity of the ears of the listener when the tubular duct is rotated by the support mechanism to bring the front end aperture toward the vicinity of the ears of the listener.

3. The apparatus according to claim 1, wherein the tubular duct has a bow-like profile that is curved toward the front end thereof.

4. The apparatus according to claim 1, wherein the tubular duct operates as a duct for a bass reflex type speaker.

5. The apparatus according to claim 1, wherein the tubular duct is fitted to a second speaker for medium to high tone ranges at the front end thereof.

6. The apparatus according to 1, wherein the speaker is fitted to a back end of the tubular duct.

7. The apparatus according to claim 1, wherein the speaker is a first speaker which is fitted to a back end of the tubular duct, and a second speaker is fitted at a front end of the tubular duct.

8. The apparatus according to claim 7, wherein the first speaker is moved away from the vicinity of the ears of the listener and the second speaker is moved toward the vicinity of the ears of the listener when the tubular duct is rotated by the support mechanism to bring the front end aperture toward the vicinity of the ears of the listener.

* * * * *